US008768151B2

(12) United States Patent
Tai et al.

(10) Patent No.: US 8,768,151 B2
(45) Date of Patent: Jul. 1, 2014

(54) HEATING AND COOLING APPARATUS

(76) Inventors: Yung-Ming Tai, Tao-Yuan (TW); Edwin Ho, Irvine, CA (US)

( * ) Notice: Subject to any disclaimer, the term of this patent is extended or adjusted under 35 U.S.C. 154(b) by 600 days.

(21) Appl. No.: 13/035,016

(22) Filed: Feb. 25, 2011

(65) Prior Publication Data

US 2012/0216985 A1 Aug. 30, 2012

(51) Int. Cl.
*F24H 3/02* (2006.01)
*F24D 15/02* (2006.01)

(52) U.S. Cl.
USPC ..... 392/360; 392/365; 392/367; 392/368

(58) Field of Classification Search
None
See application file for complete search history.

(56) References Cited

U.S. PATENT DOCUMENTS 3,765,475 A * 10/1973 Hooper ..... 165/267
4,146,974 A * 4/1979 Pray ..... 34/571
4,356,965 A * 11/1982 Matsushima et al. .... 237/12.3 B
4,406,214 A * 9/1983 Sakurai ..... 454/126
4,459,466 A * 7/1984 Nakagawa et al. ..... 392/307
5,279,459 A * 1/1994 Single, II ..... 237/2 A
5,505,251 A * 4/1996 Sarbach ..... 165/202
6,278,083 B1 * 8/2001 Schwarz ..... 219/202
7,275,586 B2 * 10/2007 Beck et al. ..... 165/42

* cited by examiner

*Primary Examiner* — Thor Campbell
(74) *Attorney, Agent, or Firm* — Frank Marino

(57) ABSTRACT

A portable air blowing appliance has a housing retaining a blower adapted when energized to create an airflow through and from the housing, and a heating element adapted when energized to impart heat to the airflow. A movable deflector selectively steers the airflow either though or not through the heating element. In the exemplary embodiment shown, the blower is, in combination, a motor-driven centrifugal blower rotatable about a blower axis to create the airflow, and a scroll surrounding the blower wheel and adapted to direct the airflow from the blower wheel forwardly from the housing. In this exemplary embodiment, the deflector is movable about a pivot axis perpendicular to the blower axis between a heating position wherein the airflow is steered through the heating element and a cooling position where the airflow is steered not through the heating element.

10 Claims, 15 Drawing Sheets

HEATING AND COOLING APPARATUS

FIELD OF THE INVENTION

This invention relates to household heaters, fans and blowers, and more specifically, to such portable appliances having centrifugal blower wheels surrounded by scrolls for directing a warm or cool airflow into the surrounding environment.

BACKGROUND OF THE INVENTION

There is an ever-increasing need to obtain localized heating at home and in the work place. There is also an ever-increasing need to obtain localized cooling or ventilating air flow in those places. As costs rise and incomes fall in a declining economy, the need to obtain a variety of such functions in a single portable appliance becomes more and more advantageous.

Existing air blowing appliances typically prevail in two main types; axial fans and centrifugal blowers. Axial fans have an electric motor typically oriented such that its rotational axis is aligned with the direction of air movement. An air propeller affixed to the motor's rotor rotates about the axis and causes air to be pushed forwardly from the fan in the direction along the axis. Centrifugal blowers have an electric motor typically oriented such that its rotational axis is perpendicular to the direction of air movement. A blower wheel affixed to the motor's rotor rotates about the axis and causes air to be pulled into the wheel, then pushed outwardly toward a surrounding scroll, which focuses and guides the airflow forwardly from the appliance.

Certain electrical air heaters also incorporate such a blower wheel and scroll, along with a heating element. Air is pushed or pulled through the element to be warmed before it exits the appliance. While airflows from cooling appliances are preferably made high to cause a "wind chill" effect when the airflow impacts the user, airflows are preferably made low from air heaters to avoid such an effect, which would contradict their intended warming function.

Variable air flow rates from centrifugal blowers are typically achieved by variation of the motor speed, either by using a speed controller or by including a multitude of taps into the motor coil, either of which adds cost, complexity, and an additional opportunity for failure compared to a single speed blower.

There exists the need for an efficient portable air blowing appliance which selectively provides cooling at a higher airflow, and warming at a lower airflow, and such is an object of the present invention.

There exists the need for such an appliance which selectively provides either airflow without the need for a speed controller, and such is an object of the present invention.

There exists the need for such an appliance which selectively provides either airflow without the need for a multiple-speed motor, and such is an object of the present invention.

There exists the need for such an appliance which selectively provides either airflow without the need for multiple motor coils or taps, and such is an object of the present invention.

Other needs and objects will become apparent upon a reading of the following disclosure in combination with the appended drawings.

SUMMARY OF THE INVENTION

The present invention may be embodied as a portable air blowing appliance having an elongate housing with an elongate scroll defining an airflow passage. As described herein, such an exemplary embodiment may include an elongate blower surrounded by the scroll and adapted when energized to move air through the airflow passage. The airflow passage may be arranged to cause the moved air to be sent forwardly from the appliance and into the surrounding environment. By a user-controlled mechanism, the airflow may be either directed from the appliance at the user at a high airflow rate for cooling, or may be passed through a heating element, where it is warmed and slowed, and directed from the appliance into the surrounding environment at a lower airflow rate for warming.

According to the exemplary embodiment disclosed and described herein as a portable air blowing appliance, the invention may include a housing, a blower retained by the housing and adapted when energized to create an airflow through and from the housing, a heating element retained by the housing and adapted when energized to impart heat to the airflow, and a movable deflector for selectively steering the airflow either though or not through the heating element.

The blower may be, in combination, a motor-driven centrifugal blower rotatable about a blower axis to create the airflow, and a scroll surrounding the blower wheel and adapted to direct the airflow from the blower wheel forwardly from the housing. The deflector may be movable about a pivot axis perpendicular to the blower axis between a warming position wherein the airflow is steered through the heating element and a cooling position where the airflow is steered not through the heating element.

The appliance may include a switch actuatable in cooperation with movement of the deflector such that the heating element is energized only when the deflector is in the heating position. The heating element may be an electrical heating element and the switch may be an electrical switch.

The heating element may be disposed aerodynamically downstream of the blower so that air flow from the blower is pushed through the heating element by the blower when the deflector is in the heating position. Or, the heating element may be disposed aerodynamically upstream of the blower so that air flow from the blower is pulled through the heating element by the blower when the deflector is in the heating position.

The invention may be embodied in any appliance configured for selectively providing either a warm airflow or a cool airflow, characterized by the warm airflow having a lower flow volume than the cool airflow. The warm and cool airflows may each be created by a blower having identical operating characteristics for both airflows, and the lower flow volume of the warm airflow may be achieved by steering air from the blower through an airflow-impeding heating element.

The steering may be caused by a movable deflector which selectively steers air from the blower through the airflow-impeding heating element only during a heating configuration. The heating element may be energized to warm the air from the blower only during the heating configuration. The deflector may be movable to a cooling configuration wherein the deflector steers air from the blower not through the heating element. The heating element may be de-energized automatically when the deflector is moved to the cooling configuration.

The invention may be embodied in a method of treating air by an appliance configured for selectively providing either a warm airflow or a cool airflow, wherein both the warm and cool airflows are created by a blower having identical operating characteristics for both airflows. The method may include steering air from the blower through an airflow-impeding heating element during a heating mode to cause the warm airflow, and alternatively steering air from the blower not through the airflow-impeding heating element during a cooling mode to cause the cool airflow, whereby the warm airflow during the heating mode has a lower flow volume and speed than the cool airflow during the cooling mode. The method may also include energizing the heating element only during the heating mode.

The steering may be accomplished by a selectably movable air deflector which may cooperate with the heating element to energize the heating element only during the heating mode.

Additional aspects of the invention can be appreciated upon perusal of the following detailed description of an exemplary air blower according to the invention along with the accompanying drawings. The components in the drawings are not necessarily to scale, emphasis instead being placed upon clearly illustrating the principles of the invention. Moreover, in the drawings, like reference numerals designate corresponding parts throughout the several views.

DETAILED DESCRIPTION OF THE INVENTION

Figure 1:
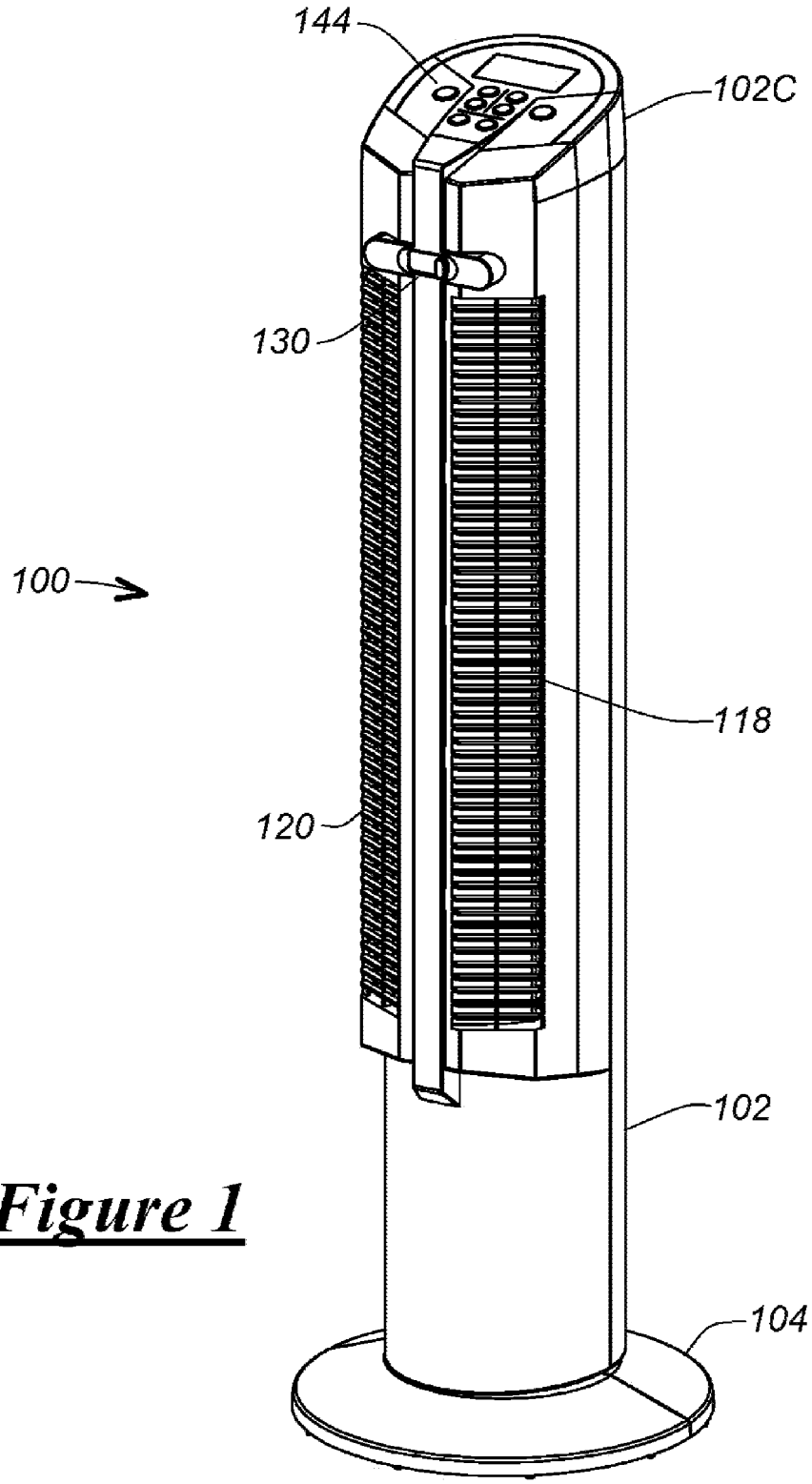
FIG. 1 is a perspective view of a portable air blowing appliance in accordance with an exemplary embodiment of the invention.
Figure 2:
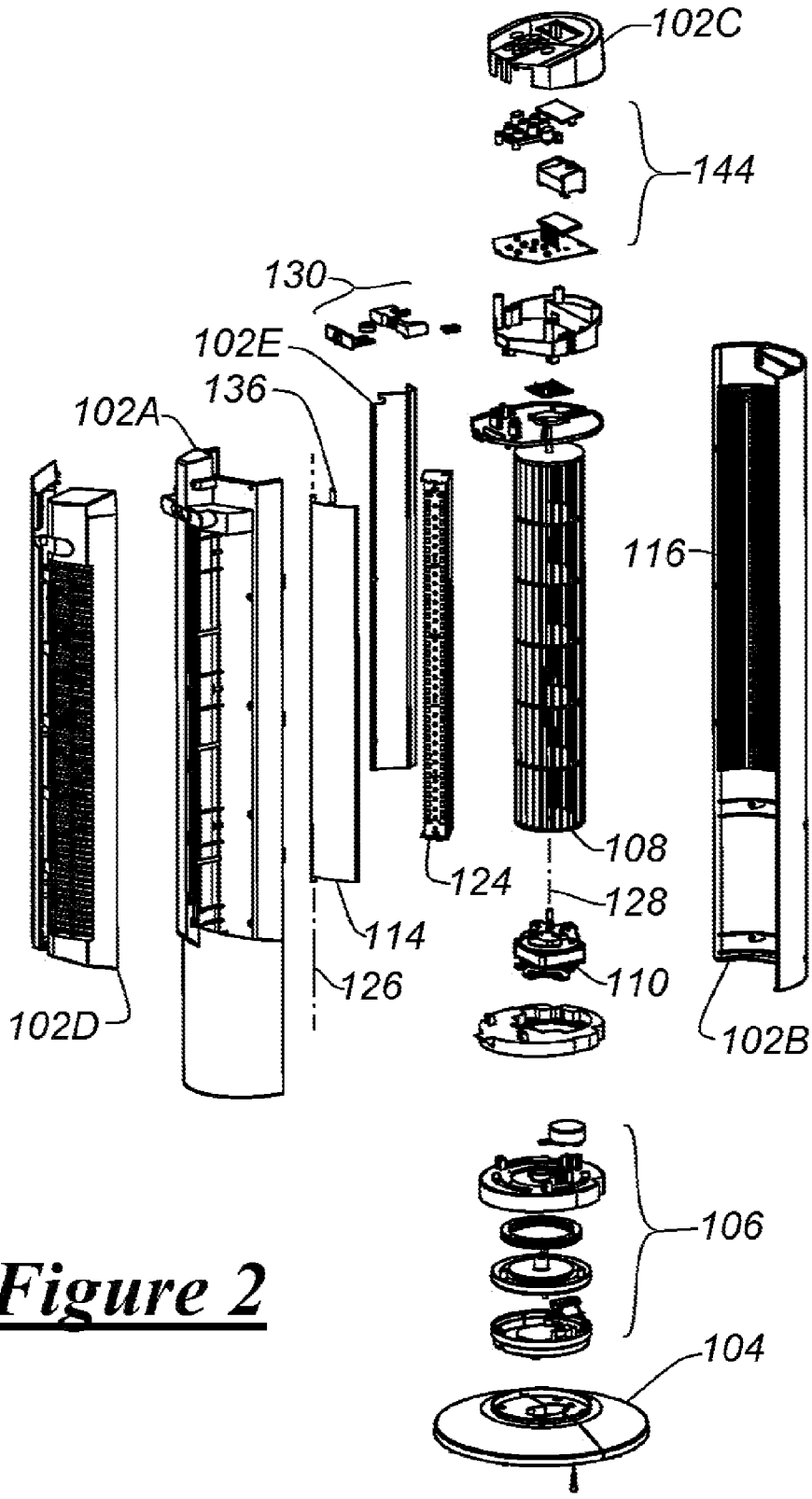
FIG. 2 is an exploded view of the appliance of FIG. 1.
Figure 3:
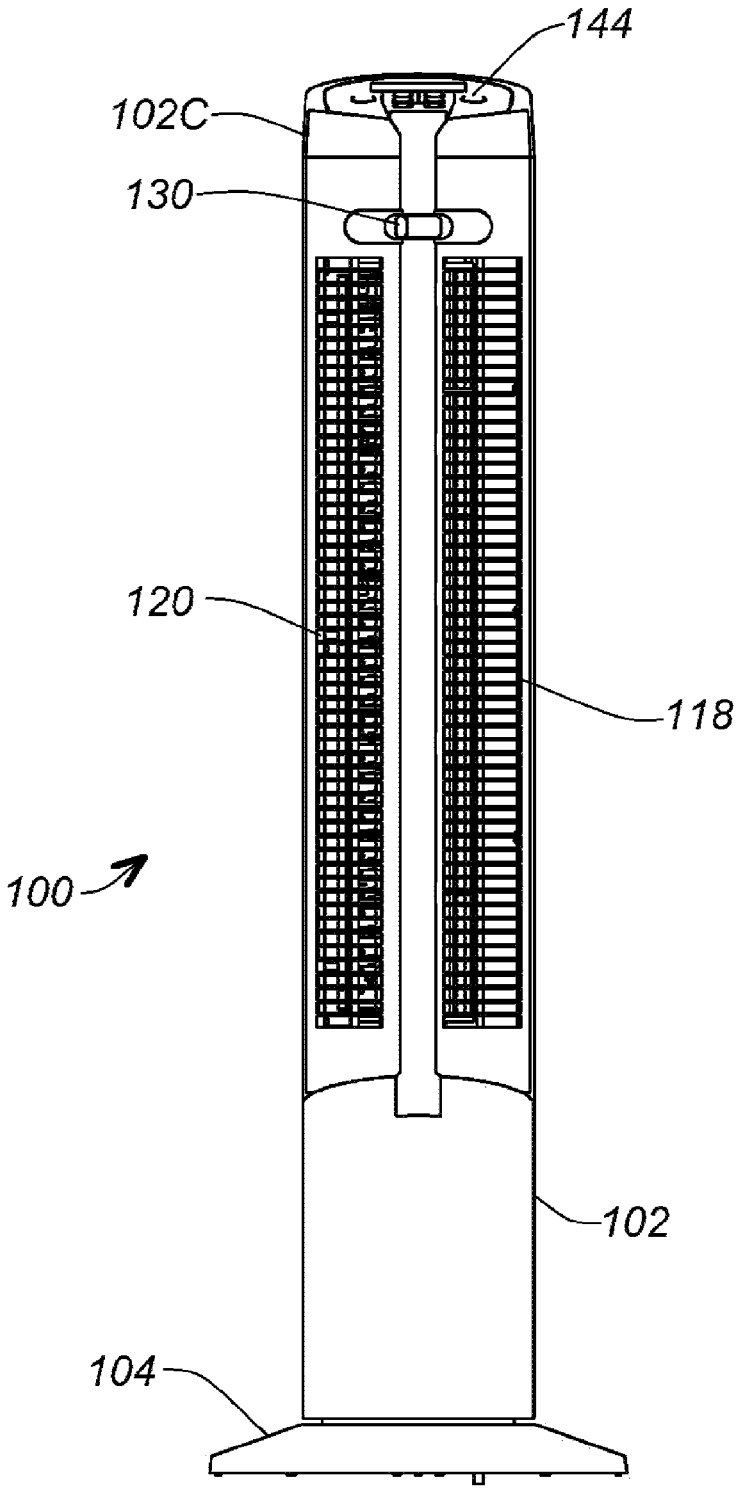
FIG. 3 is a view of the front of the appliance of FIG. 1.
Figure 4:
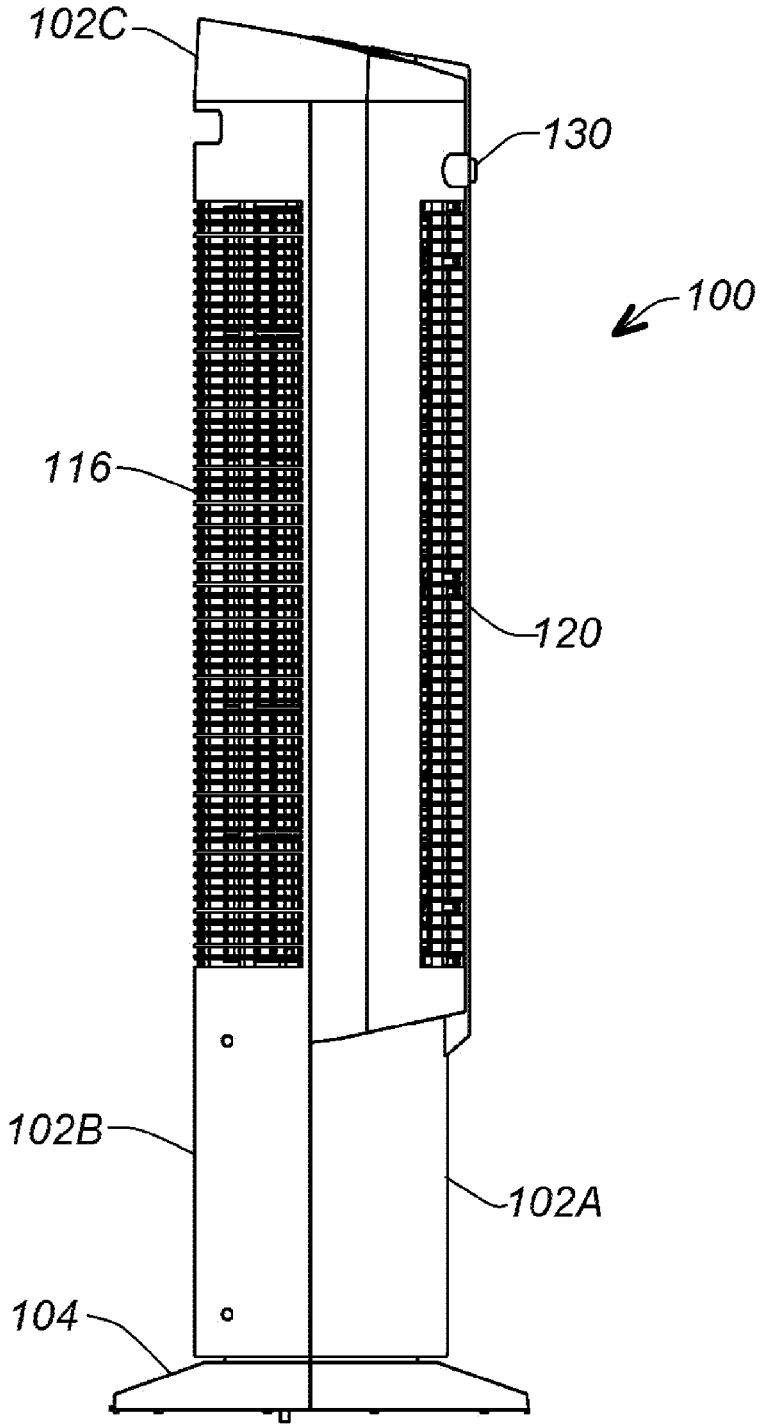
FIG. 4 is a view of the right side of the appliance of FIG. 1.
Figure 5:
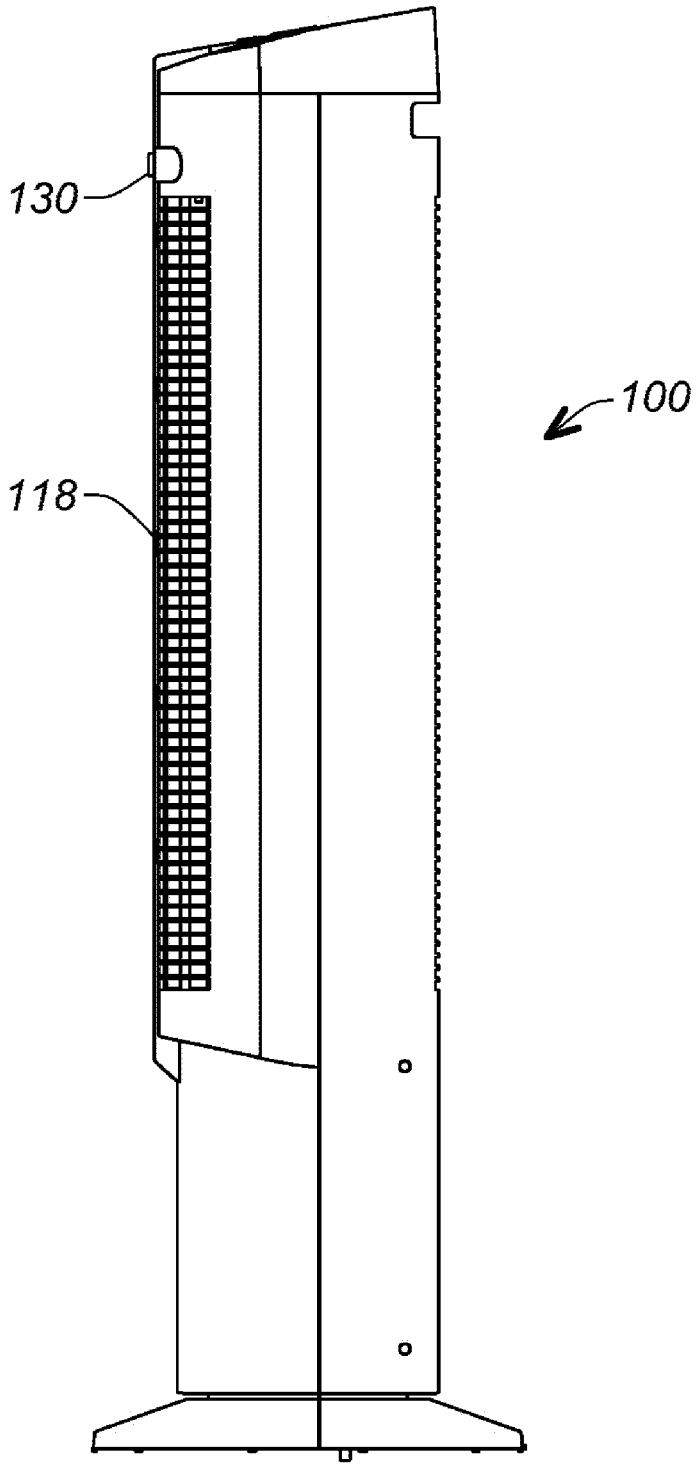
FIG. 5 is a view of the left side of the appliance of FIG. 1.
Figure 6:
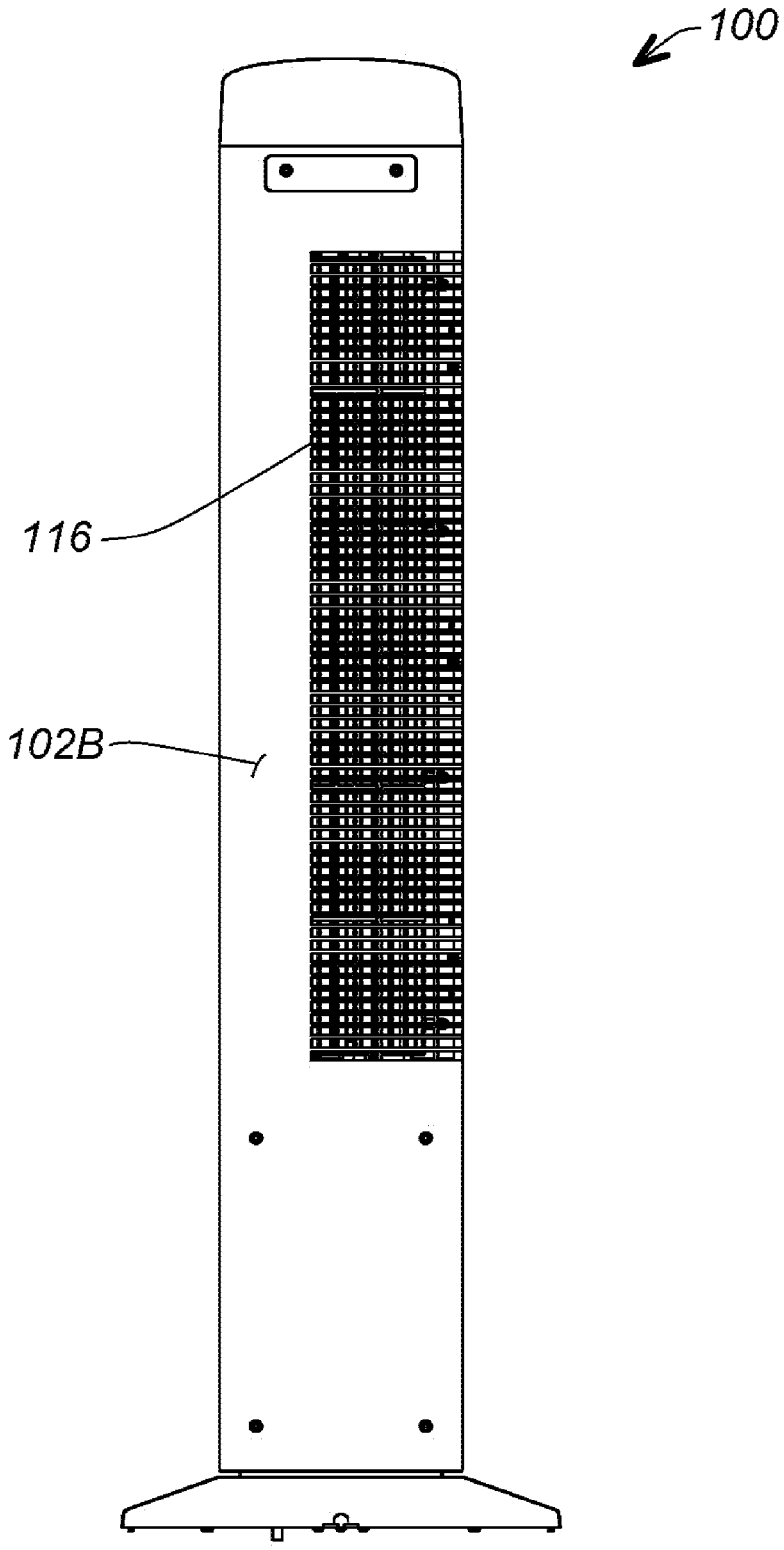
FIG. 6 is a view of the rear of the appliance of FIG. 1.
Figure 7:
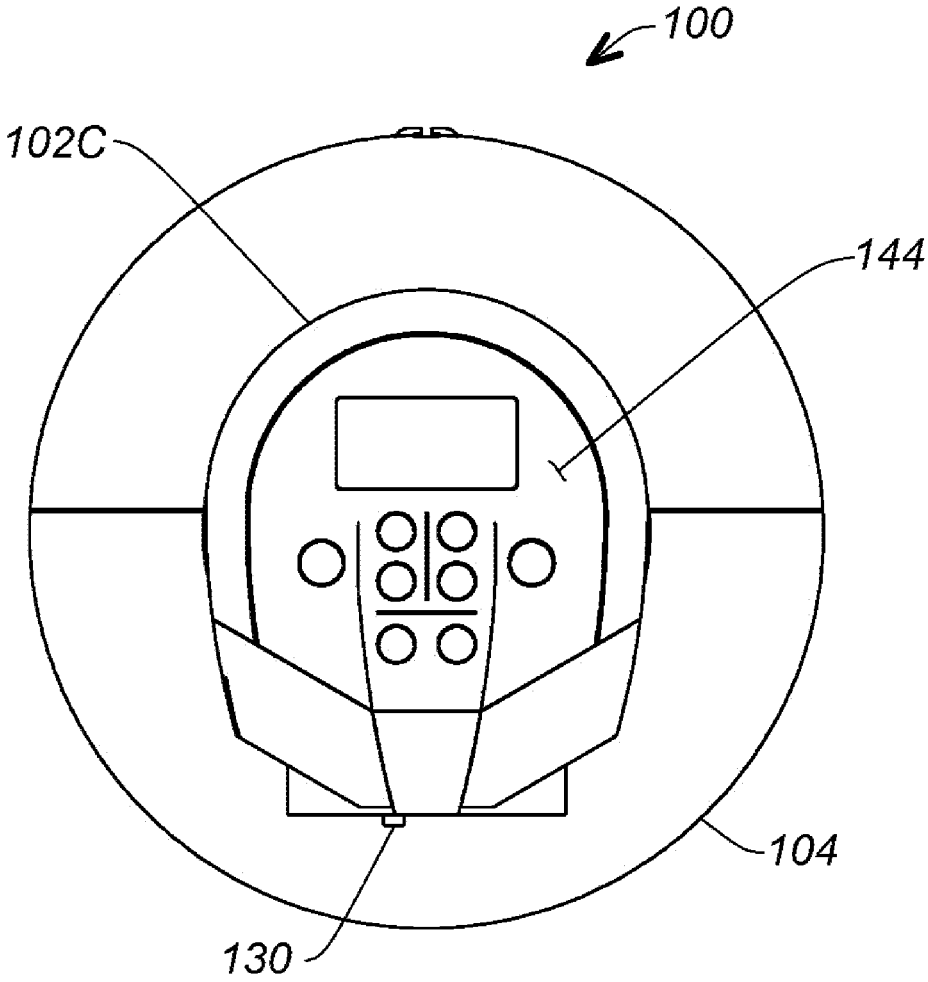
FIG. 7 is a view of the top of the appliance of FIG. 1.
Figure 8:
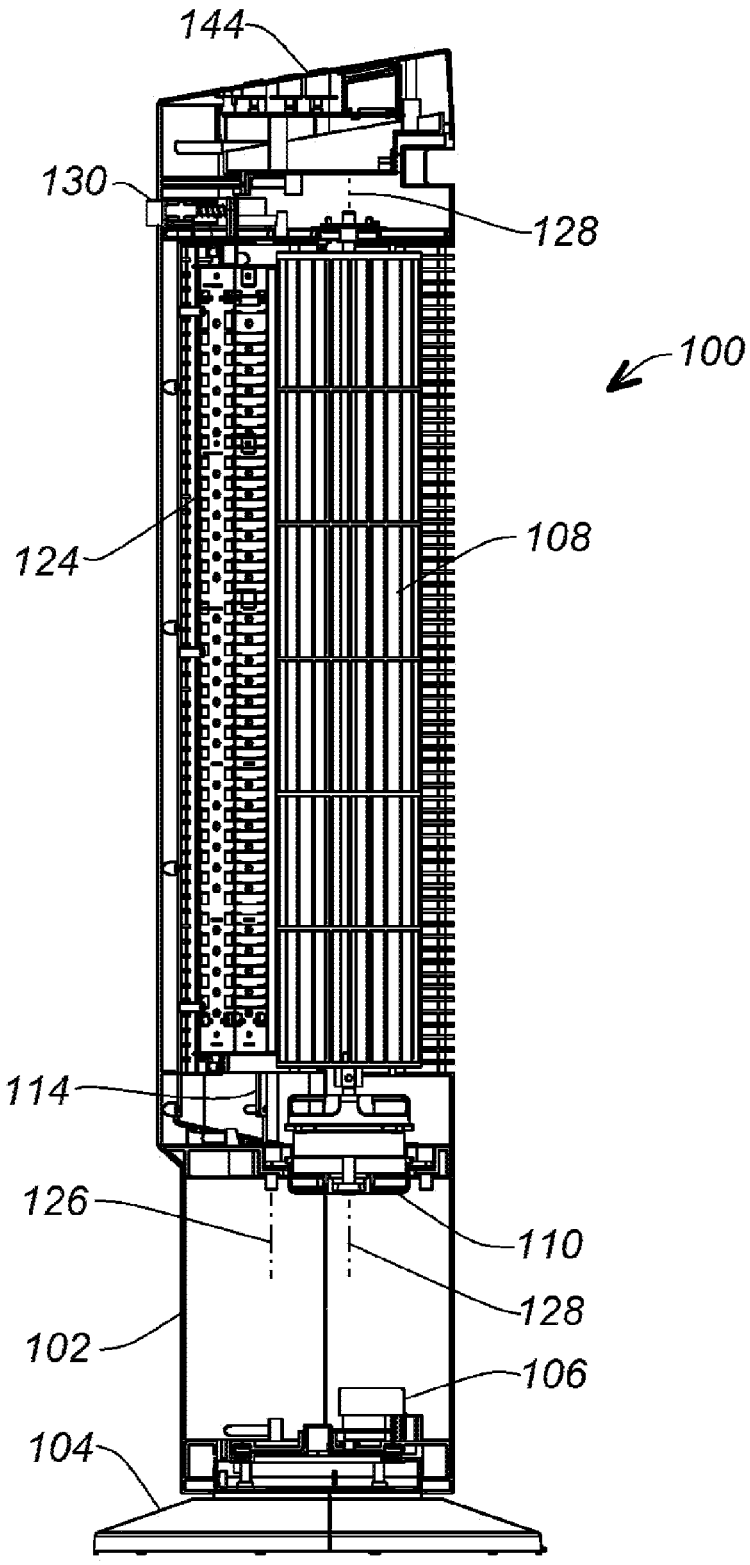
FIG. 8 is a cross-sectional side view of the appliance of FIG. 1.
Figure 9:
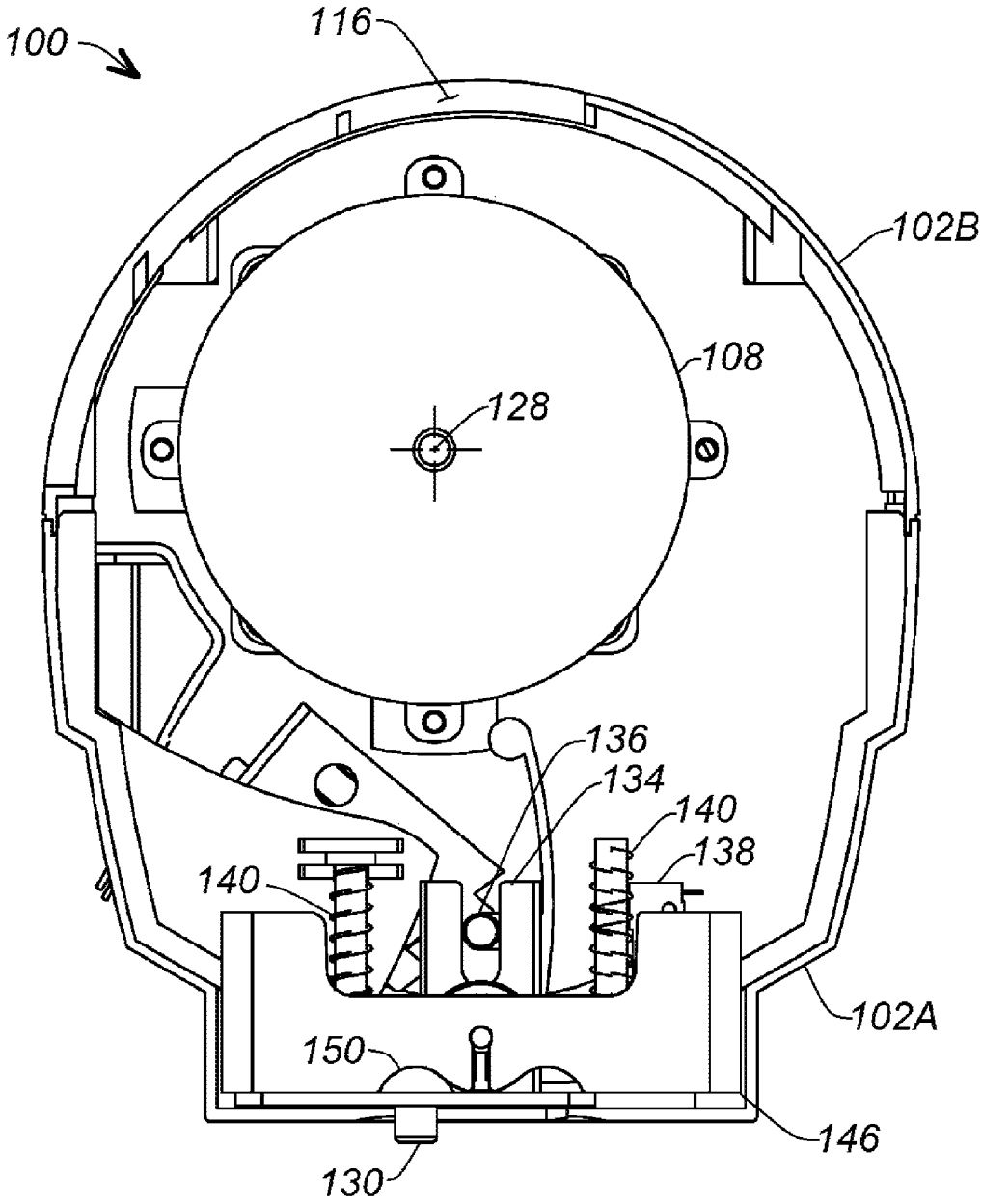
FIG. 9 is a cross-sectional top view of the appliance of FIG. 1, through its deflector actuating mechanism, during the cooling mode.
Figure 10:
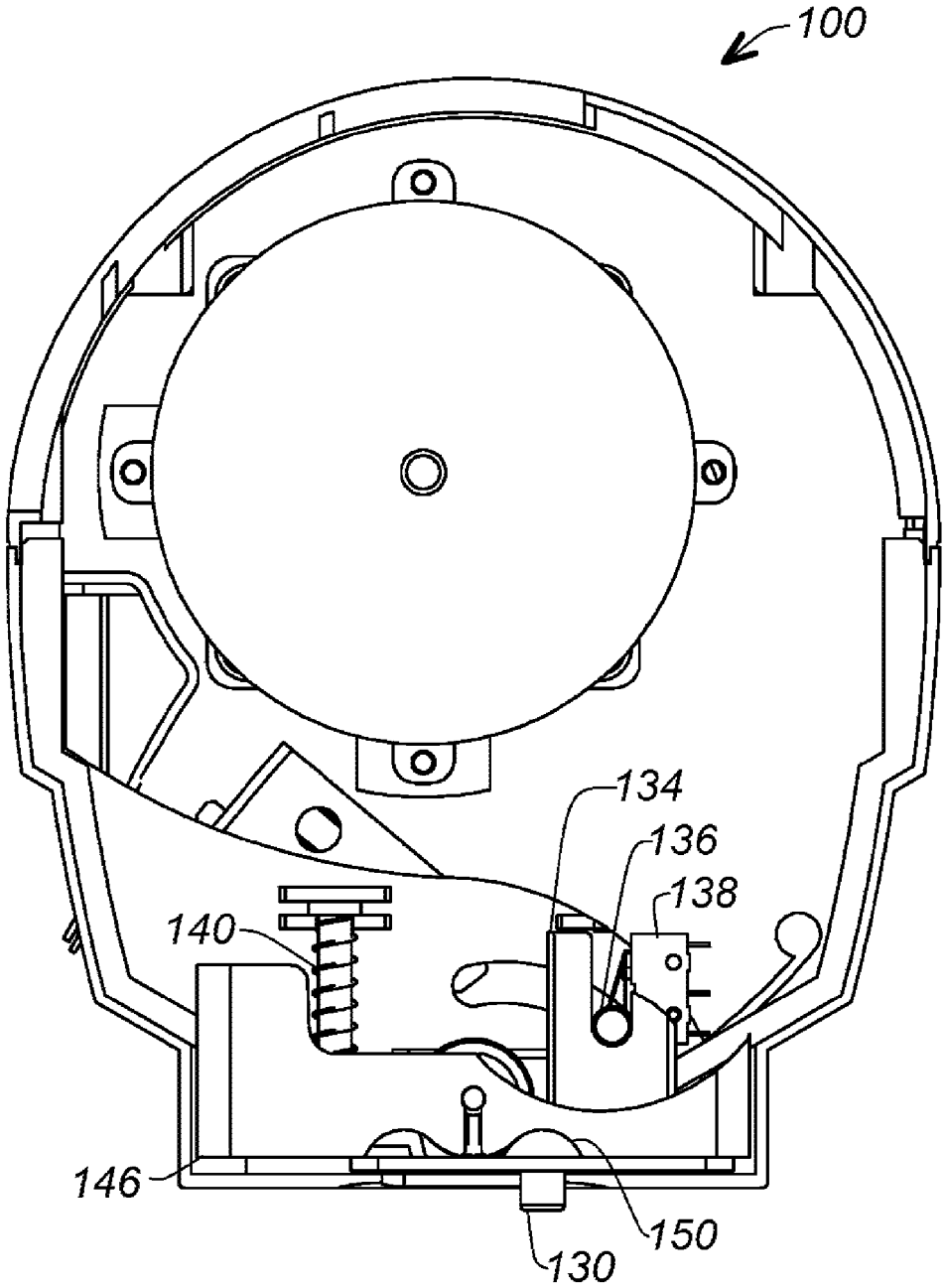
FIG. 10 is a cross-sectional top view of the appliance of FIG. 1, through its deflector actuating mechanism, during the warming mode.

FIGS. 1-15 illustrate a portable air blowing appliance 100 according an exemplary embodiment of the present invention. The appliance includes a housing 102 and a base 104, connected by a motorized oscillation arrangement 106. The housing is made of front cover 102A, rear cover 102B, top cover 102C, front grill 102D, and cut-off 102E.

The elongate front and rear covers, together with the cut-off, are assembled around, and form a scroll around blower wheel 108, which is connected to and rotatable by electric blower motor 110. Deflector 114, movable within the housing, serves as a changeable air director in conjunction with the scroll.

Figure 14:
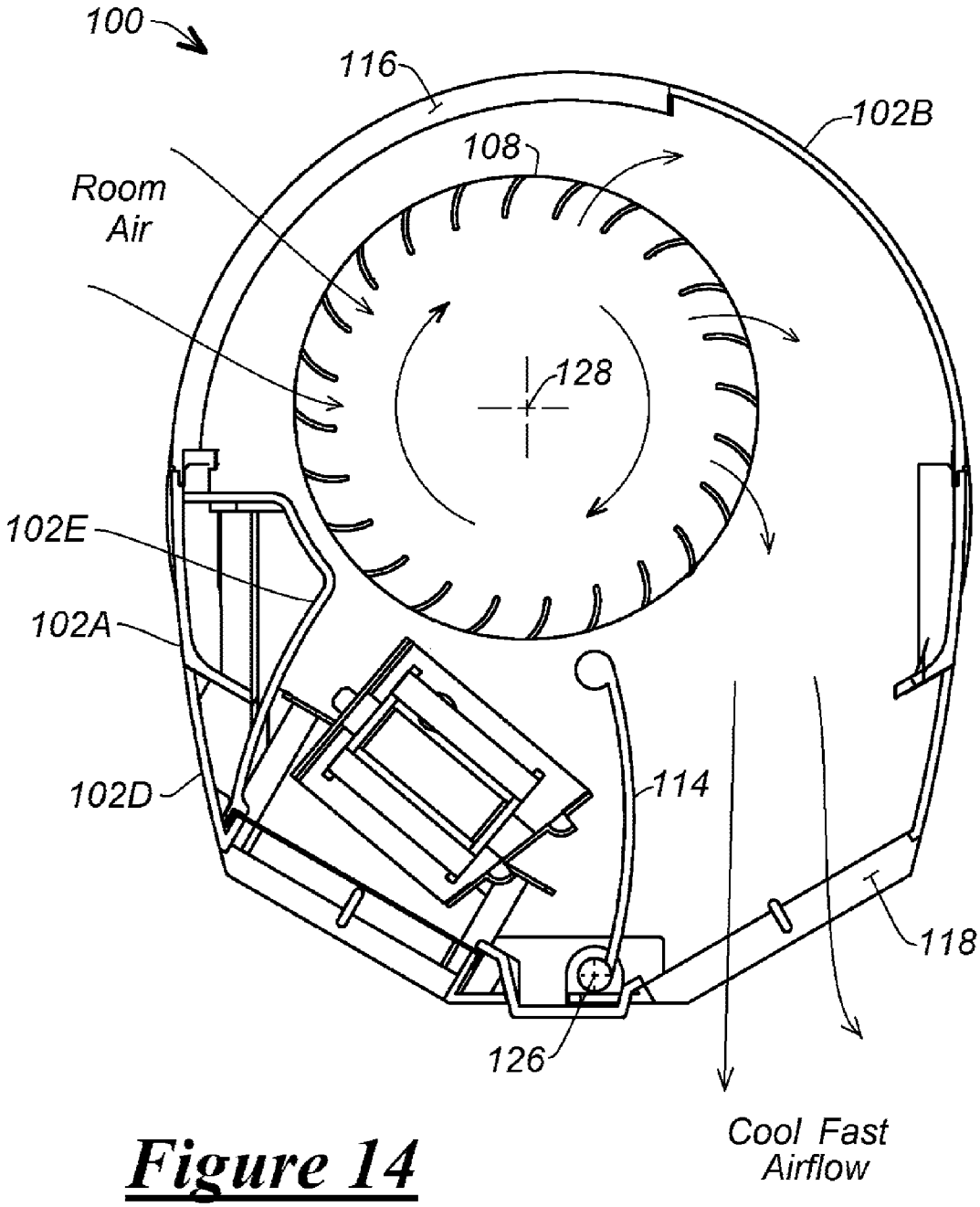
FIG. 14 is a cross-sectional top view of the appliance of FIG. 1, through its blower and deflector, during the cooling mode.
Figure 15:
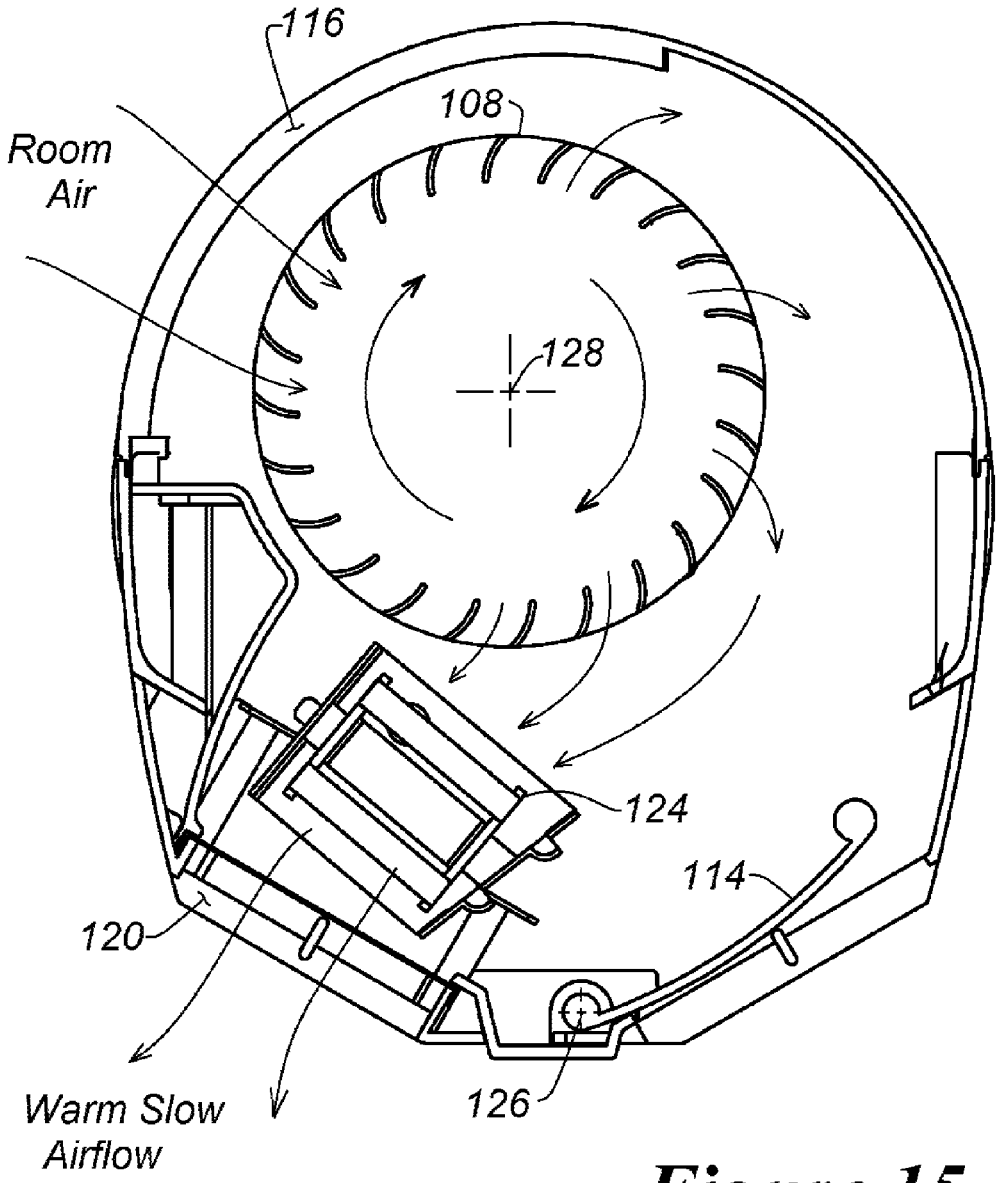
FIG. 15 is a cross-sectional top view of the appliance of FIG. 1, through its blower and deflector, during the warming mode.

As seen best in FIGS. 14 and 15, clockwise rotation of the blower wheel within the scroll formed by the surrounding housing causes air to be sucked into the wheel through intake grill 116 and to be forced centrifugally from the wheel to be directed by the scroll and deflector and blown forwardly from the appliance through the front grill.

During the cooling mode of FIG. 14, the airflow exiting the front grill is directed by the movable deflector out of the front grill's cooling exhaust opening 118. During the warming mode of FIG. 15, the airflow exiting the front grill is directed by the movable deflector out of the front grill's warming exhaust opening 120, after being forced through airflow-impeding heating element 124. This change in direction of the airflow is caused by the repositioning of deflector 114, which can be best appreciated by a comparison of the deflector's cooling mode position in FIG. 14 and warming mode position in FIG. 15.

Movement of the deflector is pivotal about a vertical hinge axis 126, which is perpendicular to the vertical blower axis about which blower wheel 108 rotates. This pivotal movement is caused by the user's sliding actuation of deflector actuator 130, from the cooling mode position of FIG. 9 to the warming mode position of FIG. 10. The sliding of the actuator causes its fork portion 134 to engage the deflector's pin 136 and cause the pivoting of the deflector. As the pin approaches heater activation switch 138 during movement from the deflector's cooling position toward its heating position, the switch is closed by contact with the pin to energize heating element 124 such that heat is imparted by the heating element into the airflow passing through it. Conversely, the heating element is de-energized for safety and economy when the switch is re-opened as the actuator is moved back to the cooling position.

Figure 11:
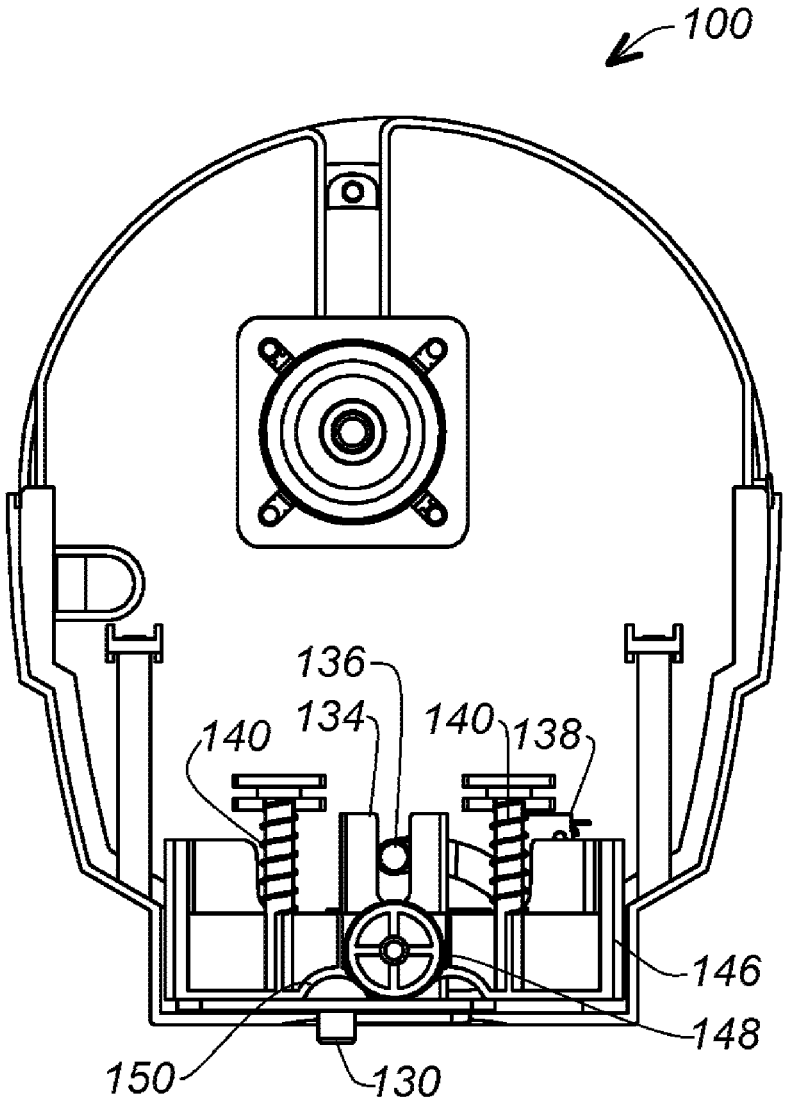
FIGS. 11 through 13 are a sequential series of partial cross-sectional views of the deflector actuating mechanism of the appliance of FIG. 1, being moved from the cooling position to the warming position.
Figure 12:
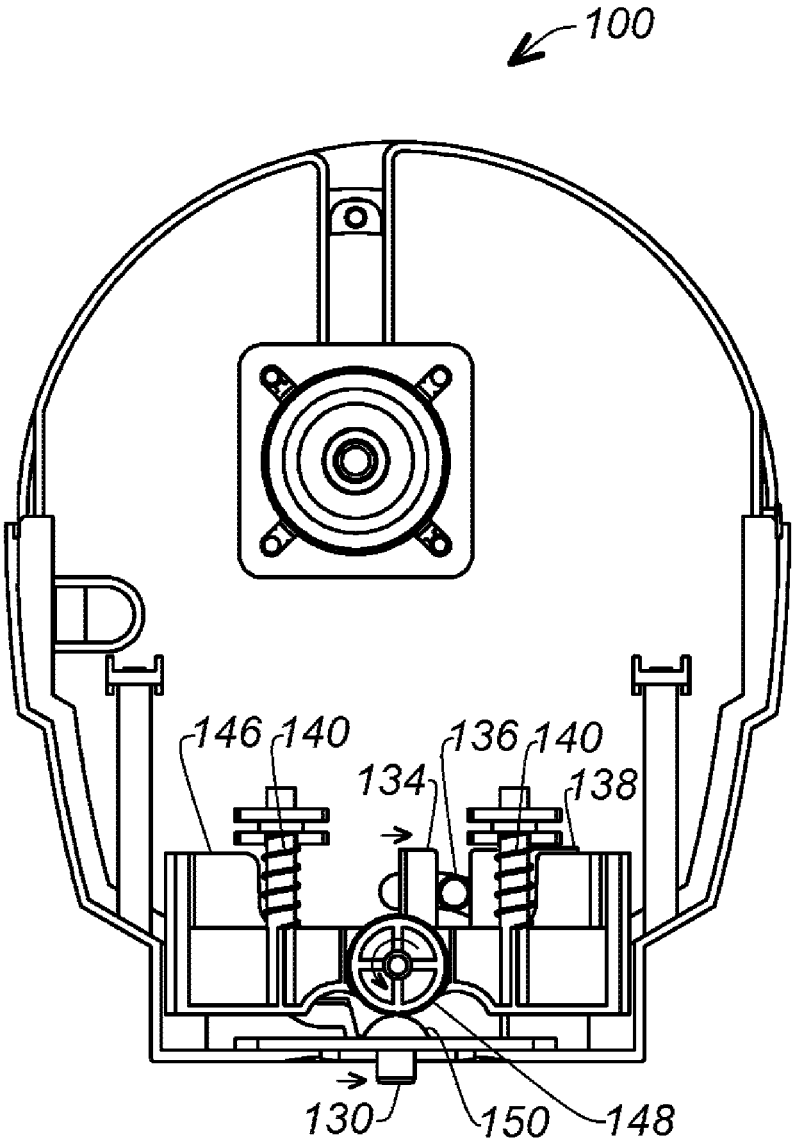
Figure 13:
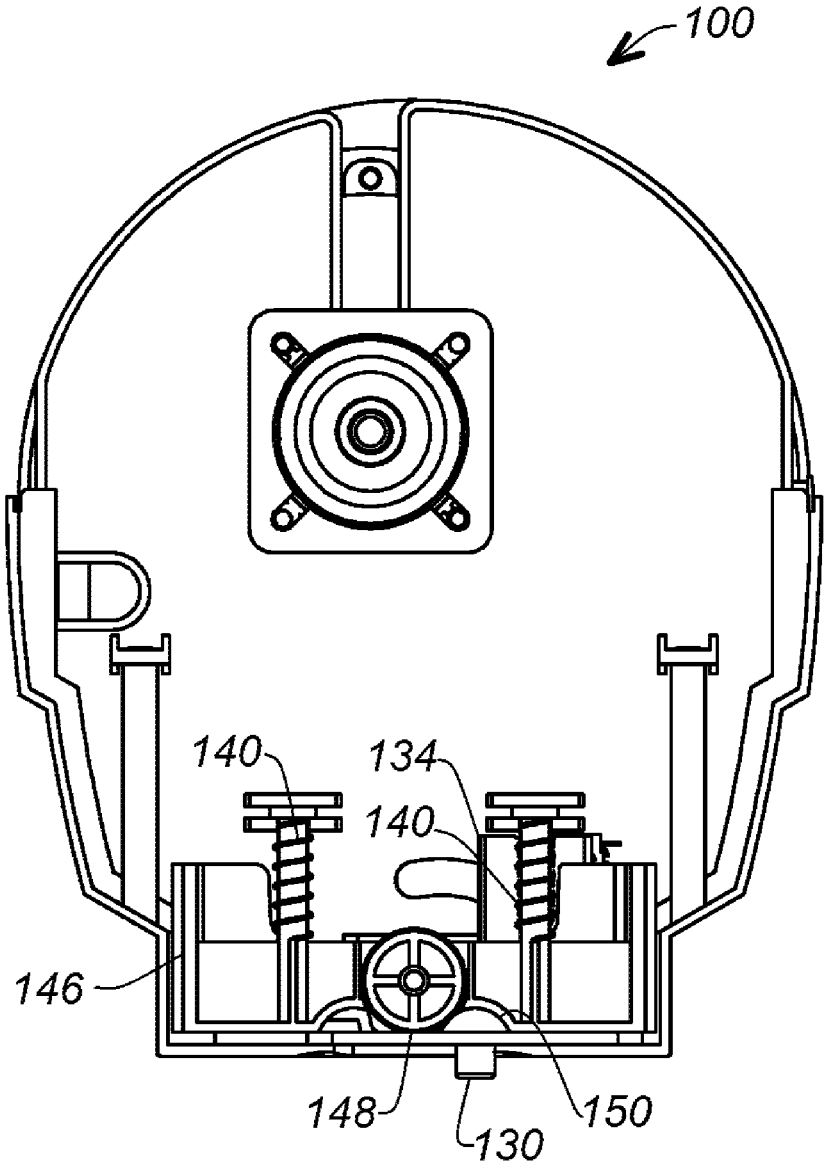

FIGS. 11 through 13 depict the functioning of the deflector actuating mechanism. The features of the actuator provide for a "snap-action" motion of the actuator between the cooling and warming positions. Springs 140 push between the housing and actuator positioning block 146 to bias the positioning block's rotatable wheel 148 against a semicircular bump 150 projecting from the back of actuator 130. As seen by comparison of FIGS. 11, 12, and 13, as the actuator is slid from its cooling position of FIG. 11, the bump forces the wheel to roll and move backwards, with the positioning block, against the force of the springs.

FIG. 12 shows a transient and unstable position midway towards the warming position where the wheel and block are pushed fully back. A hypothetical release of the actuator at this point would result in the wheel forcing the actuator to either snap back into the cooling position, or snap forward into the warming position.

As the user instead continues to force the actuator "over center", that is to say beyond the position of FIG. 12 and just instantaneously further towards the warming position, the force of the springs causes the wheel to instantly force the bump fully into its warming position of FIG. 13, thereby causing the actuator's fork portion 134 to instantly engage switch 138 while moving the deflector's pin 136 to its right-most position, and to thereby "snap" the deflector into its warming position of FIG. 15. This function ensures that the actuator and deflector can only stabilize in either the cooling or warming positions, and no place in between, so that the heating element can never be energized when the deflector is not properly positioned for warming.

The unrestricted airflow through the cooling exhaust opening 118 during the cooling mode has a relatively high volume and velocity, ideal for providing a cooling breeze during, for instance, warm summer months. Activation of the motorized oscillation mechanism 106 causes the housing 102 to swing in an oscillatory fashion back and forth relative to the stationary base 104 to enable the distribution of this cooling airflow over a wide angle. Or de-activation of this oscillation allows the cooling airflow to be constantly directed at the same area. Such activation and de-activation, along with control of other electrical functions, are accomplished by switches and controls disposed at the control panel 144 of the top cover 102C. Functions which may be provided and controlled from this panel may include; appliance on/off, adjustments of the heating element power, and adjustments to the blower speed.

The restricted airflow through the heating element 124 and warming exhaust opening 120 during the warming mode has a relatively lower volume and velocity than the cooling airflow, ideal for providing a more gentle warming flow of heated air into the surrounding environment, with or without oscillation, according to the user's selection.

From the foregoing, it will be clear that the present invention has been shown and described with reference to a preferred embodiment that merely exemplifies the broader invention revealed herein. Certainly, those skilled in the art can conceive of alternative embodiments. For instance, those with the major features of the invention in mind could craft embodiments that incorporate one or more major features while not incorporating all aspects of the foregoing exemplary embodiment. Obviously, many modifications and variations of the present invention are possible in light of the above teachings. It is to be understood, therefore, that the invention can be practiced otherwise than as specifically described. With this in mind, the claims that follow will define the scope of protection to be afforded the invention, and those claims shall be deemed to include equivalent constructions insofar as they do not depart from the spirit and scope of the present invention. Certain of these claims may express certain elements as a means for performing a specific function, at times without the recital of structure or material. As the law demands, any such claims shall be construed to cover not only the corresponding structure and material expressly described in the specification but also equivalents thereof.

We claim:

1. An air blowing appliance for treating an enclosed environment and comprising:

a housing having a handle for grasping to carry the housing about within and relative to the enclosed environment, having first and second exhaust openings, and comprising a substantially semi-cylindrical first scroll portion;

a blower retained within the substantially semi-cylindrical first scroll portion and adapted when energized to create an airflow within the housing in cooperation with the substantially semi-cylindrical first scroll portion;

a deflector retained by and movable relative to the housing and forming a flexible scroll portion disposed within the airflow and selectively cooperating with the substantially semi-cylindrical first scroll portion to form either a first scroll configuration or a second scroll configuration; the first scroll configuration steering the airflow along a first airflow path and out from the housing through the first exhaust opening, and the second scroll configuration steering the airflow along a second airflow path and out from the housing through the second exhaust opening, the exiting second airflow directed parallel to the exiting first airflow; and a heating element retained by the housing and disposed within the first airflow path adjacent the first exhaust opening and adapted when energized to impart heat to the airflow;

wherein the heating element has an airflow impedance sufficient to cause the airflow from the first exhaust opening to be slower than the airflow from the second exhaust opening.

2. The portable air blowing appliance of claim 1 wherein:

the blower comprises a motor-driven centrifugal blower wheel rotatable about a blower axis to create the airflow; and both the first and second scroll configurations are adapted to direct the airflow from the blower wheel forwardly from the housing; and wherein the deflector is movable about a pivot axis parallel to the blower axis between a heating position wherein the airflow is steered along the first airflow path through the heating element and a cooling position where the airflow is steered along the second airflow path not through the heating element.

3. The portable air blowing appliance of claim 2 further comprising a switch actuatable in cooperation with movement of the deflector such that the heating element is energized only when the deflector is in the heating position.

4. The portable air blowing appliance of claim 3 wherein the heating element is an electrical heating element and the switch is an electrical switch.

5. The portable air blowing appliance of claim 4 wherein the heating element is disposed aerodynamically downstream of the blower so that air flow from the blower is pushed through the heating element by the blower when the deflector is in the heating position.

6. The portable air blowing appliance of claim 4 wherein the heating element is disposed aerodynamically upstream of the blower so that air flow from the blower is pulled through the heating element by the blower when the deflector is in the heating position.

7. The portable air blowing appliance of claim 2 further comprising a switch actuatable in cooperation with movement of the deflector such that the heating element is energized only when the deflector is in the heating position.

8. The portable air blowing appliance of claim 7 wherein the heating element is an electrical heating element and the switch is an electrical switch.

9. The portable air blowing appliance of claim 8 wherein the heating element is disposed aerodynamically downstream of the blower so that air flow from the blower is pushed through the heating element by the blower when the deflector is in the heating position.

10. The portable air blowing appliance of claim 8 wherein the heating element is disposed aerodynamically upstream of the blower so that air flow from the blower is pulled through the heating element by the blower when the deflector is in the heating position.

* * * * *